US007992644B2

(12) United States Patent
Giroux

(10) Patent No.: US 7,992,644 B2
(45) Date of Patent: Aug. 9, 2011

(54) MECHANICAL EXPANSION SYSTEM

(75) Inventor: Richard Lee Giroux, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 97 days.

(21) Appl. No.: 11/957,519

(22) Filed: Dec. 17, 2007

(65) Prior Publication Data

US 2009/0151930 A1 Jun. 18, 2009

(51) Int. Cl.
*E21B 43/10* (2006.01)

(52) U.S. Cl. ..... 166/380; 166/207

(58) Field of Classification Search ..... 166/125, 166/207, 237, 380
See application file for complete search history.

(56) References Cited

U.S. PATENT DOCUMENTS

| | | | | |
|---|---|---|---|---|
| 2,191,000 | A * | 2/1940 | Thomas | 294/86.17 |
| 2,827,966 | A * | 3/1958 | Reynolds | 166/212 |
| 3,162,245 | A | 12/1964 | Howard et al. | |
| 3,167,122 | A | 1/1965 | Lang | |
| 3,175,618 | A | 3/1965 | Lang et al. | |
| 3,179,168 | A | 4/1965 | Vincent | |
| 3,191,677 | A | 6/1965 | Kinley | |
| 3,191,680 | A | 6/1965 | Vincent | |
| 3,203,451 | A | 8/1965 | Vincent | |
| 3,203,483 | A | 8/1965 | Vincent | |
| 3,358,760 | A | 12/1967 | Blagg | |
| 3,424,244 | A | 1/1969 | Kinley | |
| 3,489,220 | A | 1/1970 | Kinley | |
| 3,669,190 | A | 6/1972 | Sizer et al. | |
| 3,691,624 | A | 9/1972 | Kinley | |
| 3,780,562 | A | 12/1973 | Kinley | |
| 3,785,193 | A | 1/1974 | Kinley et al. | |
| 4,060,131 | A * | 11/1977 | Kenneday et al. | 166/382 |
| 4,715,445 | A * | 12/1987 | Smith, Jr. | 166/377 |
| 4,811,785 | A * | 3/1989 | Weber | 166/117.7 |
| 5,348,095 | A * | 9/1994 | Worrall et al. | 166/380 |
| 5,366,012 | A * | 11/1994 | Lohbeck | 166/277 |
| 5,785,120 | A * | 7/1998 | Smalley et al. | 166/55 |

(Continued)

FOREIGN PATENT DOCUMENTS

CA 2298298 8/2000

(Continued)

OTHER PUBLICATIONS

Partial EP Search Report for Application No. EP 08253918 dated Apr. 19, 2010.

(Continued)

*Primary Examiner* — Giovanna C Wright
*Assistant Examiner* — Blake Michener
(74) *Attorney, Agent, or Firm* — Patterson & Sheridan, L.L.P.

(57) ABSTRACT

A method of repairing a damaged portion of a casing in a wellbore includes running a bottom hole assembly (BHA) into the wellbore on a conveyance and locating the BHA proximate the damaged portion. The method further includes engaging an inner wall of the casing with a friction member, rotating the conveyance thereby rotating a portion of the BHA, maintaining a portion of the BHA stationary with the friction member. The method further includes pulling the inner string, thereby engaging the inner wall of the casing with an anchor of the BHA and disconnecting a frangible connection with the anchor. An inner string is coupled to an expansion member and pulling the inner string and thereby the expansion member through an expandable tubular expands the expandable tubular into engagement with the inner wall of the casing thereby repairing the damaged portion.

12 Claims, 7 Drawing Sheets

U.S. PATENT DOCUMENTS

| | | | | |
|---|---|---|---|---|
| 6,021,850 | A * | 2/2000 | Wood et al. | 166/380 |
| 6,062,309 | A * | 5/2000 | Gosse | 166/216 |
| 6,386,292 | B1 * | 5/2002 | Bland | 166/387 |
| 6,408,945 | B1 | 6/2002 | Telfer | |
| 6,408,946 | B1 * | 6/2002 | Marshall et al. | 166/317 |
| 6,557,640 | B1 * | 5/2003 | Cook et al. | 166/380 |
| 6,622,678 | B2 | 9/2003 | Shimizu et al. | |
| 6,622,789 | B1 * | 9/2003 | Braddick | 166/277 |
| 6,691,777 | B2 * | 2/2004 | Murray et al. | 166/216 |
| 6,732,806 | B2 * | 5/2004 | Mauldin et al. | 166/382 |
| 6,820,690 | B2 * | 11/2004 | Vercaemer et al. | 166/277 |
| 6,877,567 | B2 | 4/2005 | Hirth | |
| 6,997,266 | B2 | 2/2006 | Jackson et al. | |
| 7,011,162 | B2 | 3/2006 | Maguire | |
| 7,028,770 | B2 * | 4/2006 | Smith et al. | 166/206 |
| 7,073,583 | B2 * | 7/2006 | Anderton et al. | 166/277 |
| 7,093,656 | B2 | 8/2006 | Maguire | |
| 7,114,573 | B2 | 10/2006 | Hirth et al. | |
| 7,128,162 | B2 * | 10/2006 | Quinn | 166/380 |
| 7,185,701 | B2 * | 3/2007 | Mackenzie | 166/297 |
| 7,225,870 | B2 | 6/2007 | Pedersen et al. | |
| 7,383,889 | B2 * | 6/2008 | Ring et al. | 166/382 |
| 7,503,396 | B2 * | 3/2009 | Hester | 166/384 |
| 7,533,731 | B2 * | 5/2009 | Corre et al. | 166/384 |
| 2005/0045342 | A1 | 3/2005 | Luke et al. | |
| 2005/0081358 | A1 | 4/2005 | Cook et al. | |
| 2005/0236162 | A1 | 10/2005 | Badrak et al. | |
| 2006/0124295 | A1 | 6/2006 | Maguire | |
| 2007/0187113 | A1 | 8/2007 | Hester | |
| 2008/0099210 | A1 * | 5/2008 | Gazewood | 166/377 |
| 2008/0142213 | A1 * | 6/2008 | Costa et al. | 166/250.01 |

FOREIGN PATENT DOCUMENTS

| | | |
|---|---|---|
| GB | 2423321 | 8/2006 |
| WO | WO 98/21444 | 5/1998 |

OTHER PUBLICATIONS

EP Search Report for Application No. 08253918.0—1266 / 2072750 dated Aug. 23, 2010.

Canadian Office Action for Application No. 2,645,803 dated Jun. 29, 2010.

Australian Examination Report for Australian Patent Application No. 2008255197 dated Dec. 20, 2010.

* cited by examiner

MECHANICAL EXPANSION SYSTEM

BACKGROUND OF THE INVENTION

1. Field of the Invention

Embodiments of the present invention generally relate to an apparatus and methods for expanding a tubular in a wellbore. More particularly, the apparatus and methods relate to an assembly for expanding a tubular into engagement with a downhole tubular. More particularly still, the apparatus and methods relate to a bottom hole assembly having an expandable tubular, an expansion member and an anchor configured to affix the expanded tubular to a downhole tubular.

2. Description of the Related Art

In the drilling of oil and gas wells, a wellbore is formed using a drill bit disposed at a lower end of a drill string that is urged downwardly into the earth. After drilling to a predetermined depth or when circumstances dictate, the drill string and bit are removed and the wellbore is lined with a string of casing. An annular area is thereby formed between the string of casing and the formation. A cementing operation is then conducted in order to fill the annular area with cement. The combination of cement and casing strengthens the wellbore and facilitates the isolation of certain areas or zones behind the casing including those containing hydrocarbons. The drilling operation is typically performed in stages and a number of casing or liner strings may be run into the wellbore until the wellbore is at the desired depth and location.

The casing may become damaged over time due to corrosion, perforating operations, splitting, collar leaks, thread damage, or other damage. The damage may be to the extent that the casing no longer isolates the zone on the outside of the damaged portion. The damaged portion may cause significant damage to production fluid in the zones or inside the casing as downhole operations are performed. To repair the damaged portion, an expandable liner may be run into the wellbore with an expansion cone. An anchor temporarily secures the liner to the casing. The expansion cone is then pulled through the liner using a hydraulic jack at the top of the liner. The hydraulic jack pulls the expansion cone through the liner and into engagement with the damaged casing. Thus, the liner covers and seals the damaged portion of the casing.

The hydraulic jack is limited in the amount of force it can apply to the expansion cone. Typical hydraulic jacks are limited to 35,000 kilopascal (kPa) applied to the work string. This limits the amount of expansion force applied to the expansion cone and thereby the tubular. Further, the hydraulic jack requires a high pressure pump to operate which adds to the cost of the operation. Moreover, the hydraulic jack must be located on top of the liner in order to pull the expansion cone. The location of the hydraulic jack makes it difficult to pump fluid down to the expansion cone in order to lubricate the cone during expansion. Still further, the hydraulic jack has a very small and limited stroke. Thus, in order to expand a long tubular, the hydraulic jack must be reset a number of times and pull the cone the length of several strokes of the jack.

Therefore, there exists a need for a mechanical expansion system capable of expanding a tubular with an increased force for an increased distance.

SUMMARY OF THE INVENTION

A tubular expansion system for one embodiment includes an expandable tubular. The system further includes an expansion member configured to mechanically expand the expandable tubular and an anchor configured to selectively fix the expandable tubular axially relative to a surrounding downhole surface. An inner string couples to the expansion member and is configured to enable pulling of the expansion member through the expandable tubular. Further, a latch couples the inner string to the anchor in order to release the anchor from the surrounding downhole surface.

In one embodiment, a method of repairing a damaged portion of a casing in a wellbore includes running a bottom hole assembly (BHA) into the wellbore on a conveyance and locating the BHA proximate the damaged portion. The method further includes engaging an inner wall of the casing with a friction member, rotating the conveyance thereby rotating a portion of the BHA, maintaining a portion of the BHA stationary with the friction member. The method further includes pulling the inner string, thereby engaging the inner wall of the casing with an anchor of the BHA and disconnecting a frangible connection with the anchor. An inner string is coupled to an expansion member and pulling the inner string and thereby the expansion member through an expandable tubular expands the expandable tubular into engagement with the inner wall of the casing thereby repairing the damaged portion.

BRIEF DESCRIPTION OF THE DRAWINGS

So that the manner in which the above recited features described herein can be understood in detail, a more particular description of embodiments, briefly summarized above, may be had by reference to embodiments, some of which are illustrated in the appended drawings. It is to be noted, however, that the appended drawings illustrate only typical embodiments described herein and are therefore not to be considered limiting of its scope, for the invention may admit to other equally effective embodiments.

DETAILED DESCRIPTION

Figure 1:
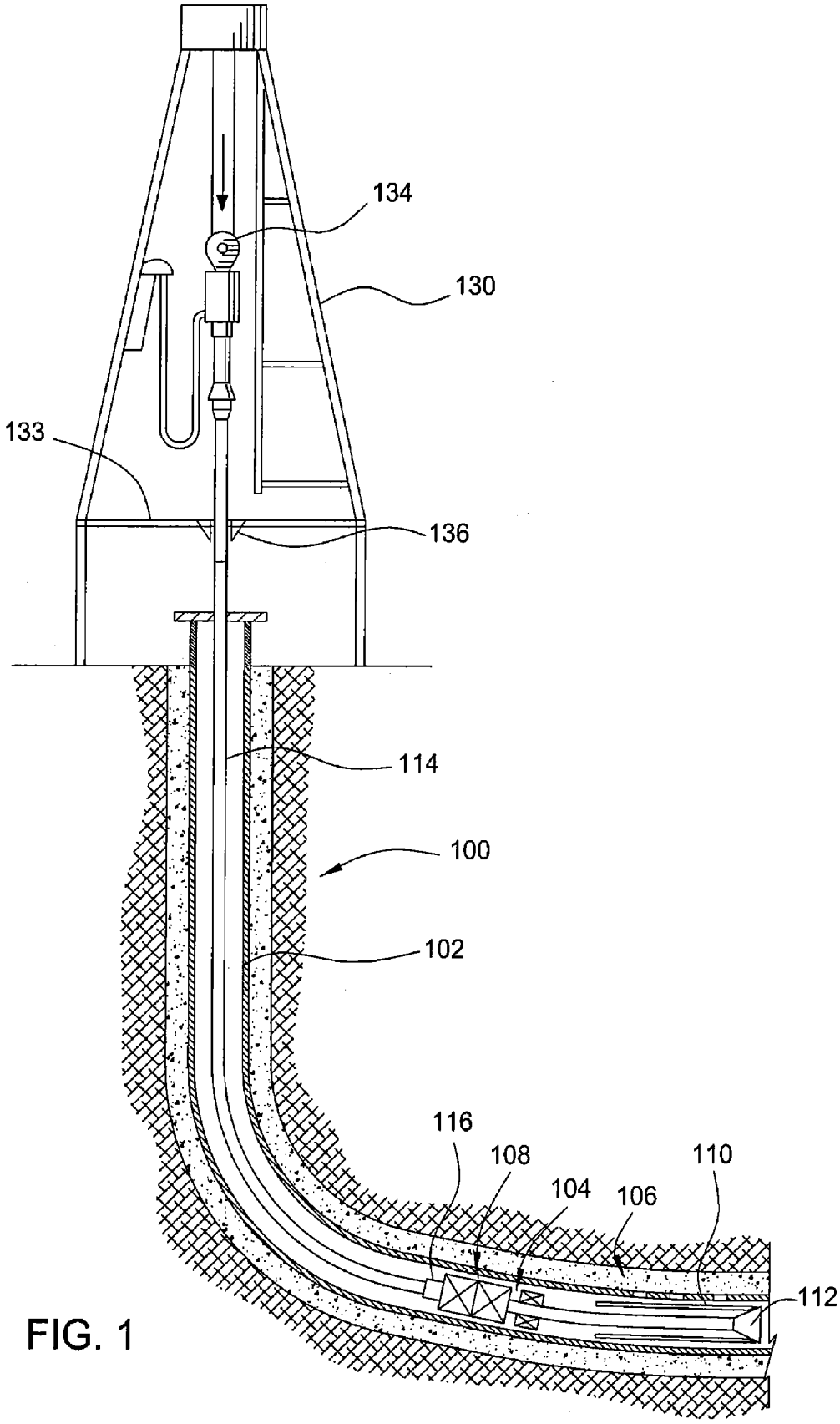
FIG. 1 is a schematic view of a wellbore according to one embodiment.

FIG. 1 is a schematic cross sectional view of a wellbore 100 which includes a casing 102 cemented into place, a conveyance 114, and a bottom hole assembly (BHA) 104. The casing 102 may include a damaged portion 106. The BHA 104 is adapted to repair the damaged portion 106 of the casing 102. The damaged portion 106 of the casing 102, as shown, is caused by a perforation operation; however, it should be appreciated that the damaged portion 106 may be the result of any damage to the casing 102 including, but not limited to, corrosion, thread damage, collar damage, damage caused by cave-in, and/or damage caused by earthquakes. The BHA 104 includes a setting assembly 108, an expandable tubular 110, and an expansion member 112. The BHA 104 is coupled to a conveyance 114 which allows the BHA 104 to be conveyed into a wellbore and manipulated downhole from the surface. The BHA 104 may be run into the wellbore 100 on the conveyance 114 until it reaches a desired location. The setting assembly 108 may then be actuated in order to engage the BHA 104 with the casing 102. With the setting assembly 108 engaged to the casing 102, the conveyance 114 may be pulled up and thereby pull the expansion member 112 through the expandable tubular 110. The conveyance 114 may transfer torque, tensile forces and compression forces to the expansion member 112. Fluid may be pumped down the conveyance 114 during the expansion in order to lubricate the expansion member 112 during expansion. Once an initial portion of the expandable tubular 110 is engaged with an inner bore of the casing 102, the setting assembly 108 may be released from the casing 102. The conveyance 114 may then pull the expansion member 112 through the expandable tubular 110 until the entire expandable tubular 110 is engaged with the inner diameter of the casing 102. The BHA 104, without the expandable tubular 110, may then be removed from the wellbore 100 leaving the damaged portion 106 of the casing 102 repaired.

The casing 102, as shown, is a tubular member which has been run into the wellbore 100 and cemented into place. The casing 102 can include one or more damaged portions 106 which require remediation. It should be appreciated that the casing 102 may be any suitable downhole tubular or formation which the expandable tubular 110 is to be expanded into including, but not limited to, a drill string, a liner, a production tubular, and an uncased wellbore.

The conveyance 114 is used to convey and manipulate the BHA in the wellbore 100. The conveyance 114, as shown, is a drill string; however, it should be appreciated that the conveyance may be any suitable conveyance, including but not limited to, a tubular work string, production tubing, drill pipe or a snubbing string. The conveyance 114 may be coupled to the BHA 104 at a connector 116.

The connector 116 may be any apparatus for connecting the conveyance 114 to the BHA 104. The connector 116, as described herein, is a threaded connection; however, it should be appreciated that the connector may be any suitable connection including, but not limited to, a welded connection, a pin connection, or a collar.

The upper end of the conveyance 114 may be supported from a drilling rig 130 by a gripping member 136 located on a rig floor 133 and/or by a hoisting assembly 134. It should be appreciated that the drilling rig may be any system capable of supporting tools for a wellbore including, but not limited to a workover rig or a subbing unit. The gripping member 136, as shown, is a set of slips; however, it should be appreciated that the griping member 132 may be any suitable member capable of supporting the weight of the conveyance 114 and the BHA 104 from the rig floor 133 including, but not limited to, a clamp, a spider, and a rotary table. The hoisting assembly 134 is configured to lower and raise the conveyance 114 and thereby the BHA 104 into and out of the wellbore 100. Further, the hoisting assembly 134 is configured to provide the pulling force required to move the expansion member 112 through the expandable tubular 110 during the expansion process. Because the hoisting assembly 134 is coupled to the drilling rig 130, the hoisting assembly 134 is capable of providing a large force to the expansion member 112. The hoisting assembly 134 may be any suitable assembly configured to raise and lower the conveyance 114 in the wellbore including, but not limited to, a traveling block, a top drive, a surface jack system, or a subbing unit hoisting conveyance. The hoisting assembly 134 and/or a spinning member located on the rig floor may provide the rotation required to operate the BHA 104.

Figure 2:
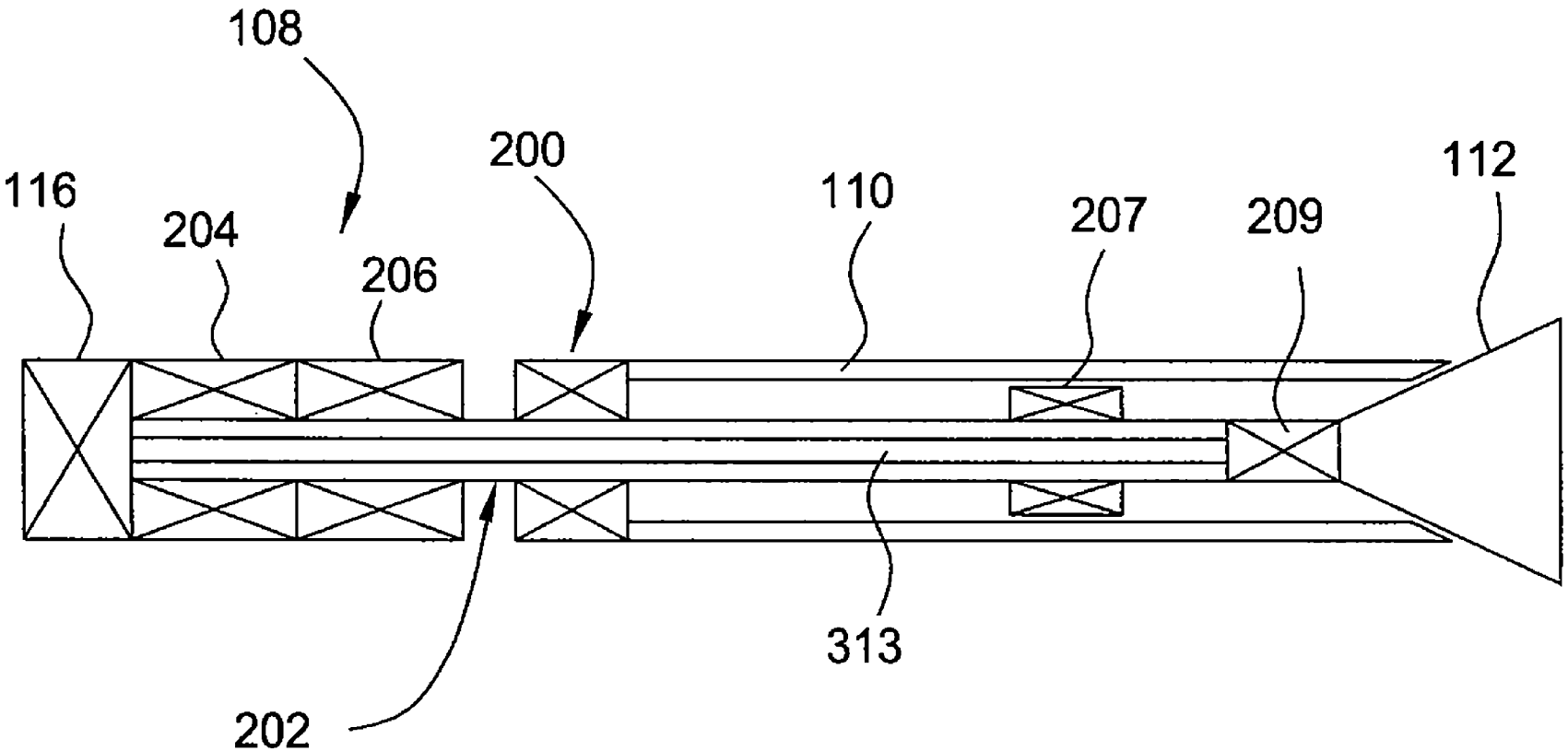
FIG. 2 is a schematic view of a bottom hole assembly (BHA) according to one embodiment.

FIG. 2 is a schematic view of the BHA 104 according to one embodiment. The BHA 104 includes the setting assembly 108, the expandable tubular 110, the expansion member 112, the connector 116, a liner stop 200, a first latch 207, a second latch 209, and one or more work strings 202. The one or more work strings 202 are configured to support and operate each of the components of the BHA 104. The setting assembly 108 includes an anchor 204 and a friction member 206. The friction member 206 engages the inner diameter of the casing 102 as the work string 202 actuates the anchor 204. The engagement of the casing 102 by the friction member 206 provides a resistive force to react to the setting force of the anchor 204 as will be described in more detail below. The friction members 206 may be any suitable device for engaging the inner diameter of the casing 102 in order to provide a resistive force including, but not limited to, drag blocks, one or more leaf springs. The anchor 204 may be any suitable device for anchoring the BHA 104 to the casing 102 including, but not limited to slips, dogs, grips, wedges, or an expanded elastomer.

With the anchor secured to the casing 102, the one or more work strings 202 may disconnect the setting assembly 108 and the expandable tubular 110 from the expansion member 112. The conveyance 114 may then pull the expansion member 112 through the expandable tubular 110 while the anchor 204 holds the tubular in place. With at least a portion of the expandable tubular 110 engaged to the inner wall of the casing 102, the first latch 207 may reconnect the one or more work strings 202. With the work strings 202 reconnected, the conveyance 114 may be manipulated to release the anchor 204 from the casing 102. The expansion member 112 then moves through the remainder of the expandable tubular 110 in order to engage the tubular to the casing 102. The work strings 202 may be configured to transfer torque and/or supply lubricating fluid to the expansion member 112.

Figure 3:
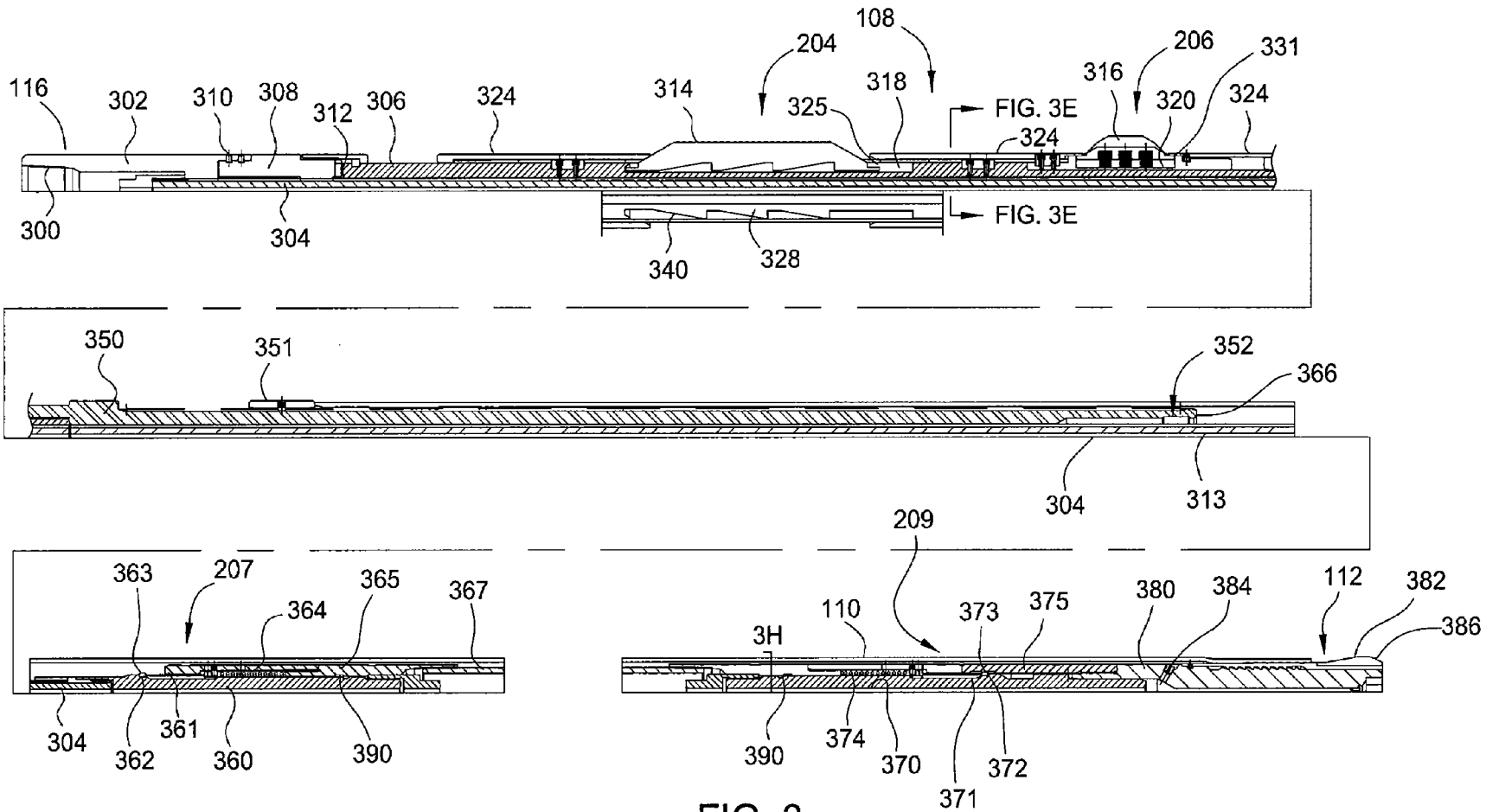
FIG. 3 is a partial cross section of the BHA according to one embodiment.

FIG. 3 is a partial cross section of the BHA 104 according to one embodiment. The connector 116 has a threaded connection 300 configured to couple the BHA 104 to the conveyance 114. The connector 116 has a body 302 which couples the connector 116 to the one or more workstrings 202. The body 302 may couple to an inner string 304 and a mandrel 306. The body 302, as shown, is threaded to the inner string 304. Although, it should be appreciated that any suitable connection may be used. The connection between the body 302 and the inner string 304 allows the conveyance 114 to transfer torque, compression, and tension to the inner string 304. The body 302, as shown, couples to the mandrel 306 via a sub connector 308. Although, it should be appreciated that the body 302 may couple directly to the mandrel 306. A frangible connection 310 connects the sub connector 308 and the body 302. The frangible connection 310 allows the mandrel 306 to be axially uncoupled from the connector 116 and thereby the inner string 304 when the expansion operation is to be performed. The frangible connection 310, as shown, is one or more shear pins; however, it should be appreciated that the frangible connection 310 may be any suitable selectively releasable connection. One or more locking dogs 312 couple the sub connector 308 to the mandrel 306 thereby allowing torque, tension, and compression to be transferred from the conveyance 114 to the mandrel prior to releasing the frangible connection 310.

Figure 3C:
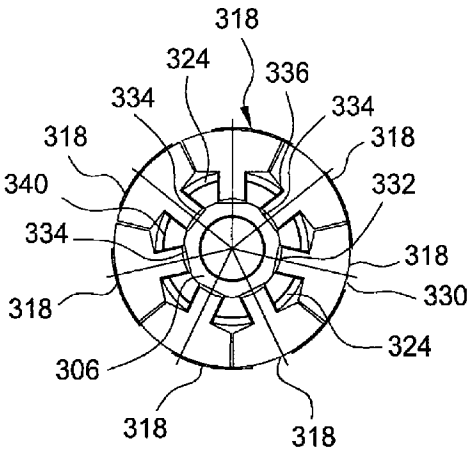
FIG. 3C is a cross sectional view of an anchor in an unactuated position according to one embodiment.
Figure 3F:
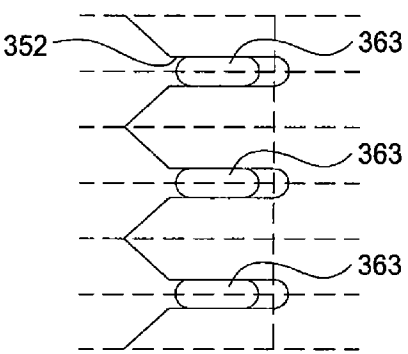
FIG. 3F is a view of a torque slots configured to receive collets according to one embodiment.
Figure 3B:
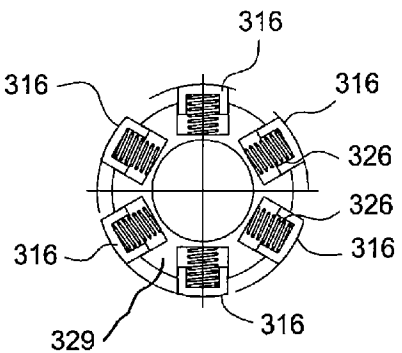
FIG. 3B is a cross sectional view of a friction member according to one embodiment.

The mandrel 306 supports and operates the setting assembly 108. The anchor 204, as shown in FIG. 3, is one or more slips 314. The friction member 206 is one or more drag blocks 316. The mandrel 306 includes a slip pocket 318 and a drag block pocket 320 configured to house the components of the anchor 204 and the friction member 206. The mandrel 306 includes a ramp 322, as shown in FIG. 3A, which urges the slips 314 toward a collapsed position during run in of the BHA 104. An angled surface 325 may be provided on an outer cover 324 to maintain the slips 314 in a collapsed position during pullout. Further, the slip pocket 318 may include one or more biasing members, not shown, configured to bias the slips 314 toward the collapsed position. The outer cover 324 may couple to the drag blocks 316 and hold the slips stationary, relative to the drag blocks 316, while the mandrel 306 is rotated to set and unset the slips. One or more blocks and/or a J-system described below may be provided to maintain the cover 324 attached to the mandrel 306.

The drag blocks 316 are configured to be biased radially away from a central axis of the BHA 104. Each of the drag blocks 316 are engaged by one or more springs 326. The springs 326 engage an outer surface of a cover extension 329, or the mandrel 306, in order to bias the drag blocks 316 away from the BHA 104. The drag block pocket 320 and/or drag block retainers 331 prevent the springs 326 from pushing the drag blocks 316 out of the BHA 104. Although shown and described as a coiled spring, it should be appreciated that the springs 326 may be any suitable member capable of pushing the drag blocks 316 radially away from the BHA 104. The springs 326 keep the drag blocks 316 engaged with an inner diameter of the casing 102 as the BHA is manipulated in the wellbore 100. The drag blocks 316 provide enough of a force to allow an operator to set the anchor 204 while not providing enough force to prevent the operator from manipulating the BHA 104 in the casing. The force created by the friction between the drag blocks 316 and the inner diameter of the casing 102 creates a resistive force for setting the anchor 204.

The slips 314 move radially inward and outward from the central axis of the BHA 104 upon the manipulation of a slip block 328 by the mandrel 306. The slip block 328 may be adapted to actuate the slips 314 by rotating the mandrel 306 and pulling the mandrel 306. Thus, axial movement of the mandrel 306 and/or the BHA 104 is reduced during the setting and unsetting of the slips 314. FIG. 3C shows a cross sectional view of the slips 314 in an unactuated position. The slips 314, as shown, have an engagement side 330 and an actuation end 332. The actuation end 332 engages the slip block 328. The engagement side 330 engages the inner wall of the casing 102 upon actuation. In the unactuated position, the actuation end 332 of each of the slips 314 is in a recess 334 of the slip block 328. The recesses 334 of the slip block 328 provide enough radial distance between the actuation end 332 and the inner wall of the casing 102 to ensure that the slips 314 are not engaged with the casing 102.

The outer cover 324 may have a guide opening 336 for the slips 314. The guide opening 336 maintains the radial location of each of the slips 314 relative to the friction member 206 during actuation. The outer cover 324 and the guide openings 336 are directly or indirectly coupled to the friction member 206. Thus, as the mandrel 306 rotates, the friction member 206 maintains the guide openings 336 and thereby the slips 314 in one radial position. In the actuated position, as shown in FIG. 3D, the mandrel 306 has rotated relative to the slips 314 and the outer cover 324. The rotation of the mandrel 306 aligns a respective longitudinal ramp 340 of the slip block 328 with each of the slips 314. Pulling of the mandrel 306 then moves the ramps 340 relative to the slips 314, thereby pushing the slips radially outward until the engagement side 330 of the slips 314 engages the inner wall of the casing 102. Continued pulling of the mandrel 306 causes teeth (not shown) of the slips 314 to bite into the casing 102. The teeth biting into the casing 102 cause the BHA 104 to be fixed relative to the casing 102. Thus, the BHA 104 may be anchored to the casing 102 by rotation and pulling of the conveyance 114 and thereby the mandrel 306.

Figure 3E:
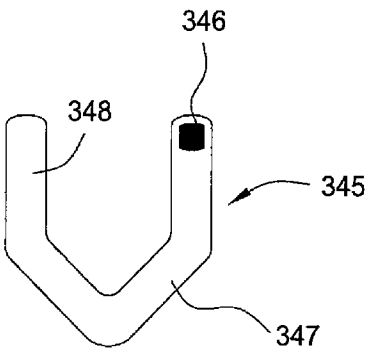
FIG. 3E is a view of a slotted path according to one embodiment.
Figure 3A:
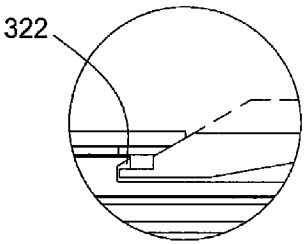
FIG. 3A is a partial view of a slip pocket according to one embodiment.
Figure 3D:
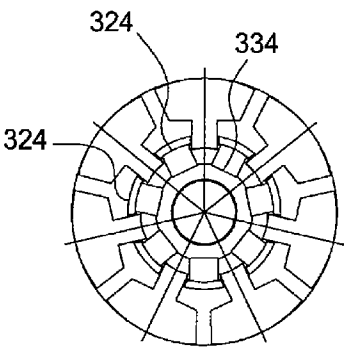
FIG. 3D is a cross sectional view of the anchor in an actuated position according to one embodiment.

The anchor 204 may include a slotted path 345, as shown in FIG. 3E, in order to ensure that the anchor remains in the actuated and/or the unactuated position until desired. The slotted path 345 may be formed in the outer cover 324 or the mandrel 306. A guide runner 346 moves along the slotted path 345 in response to the manipulation of the mandrel 306 relative to the friction member 206. As shown in FIG. 3E, the guide runner 346 is coupled to the mandrel 306, and the slotted path 345 is on the outer cover 324. The guide runner 346 is shown in the run in position. The run in position prevents the mandrel 306 from rotating relative to the slips 314, thereby preventing the unintentional actuation of the anchor 204. To set the slips 314, the mandrel 306 may be lifted and/or rotated slightly, depending on the configuration of the J-system. The friction member 206 maintains the outer cover 324 and thereby the guide runner 346 stationary as the mandrel 306 and the slotted path 345 move up. The mandrel 306 only has to rotate and/or move up a small distance before the guide runner 346 reaches a side of a slot 347 of the slotted path 345. The rotation of runner 346 allows the mandrel 306 to be rotated relative to the slips 314 thereby actuating the slips 314 as described above. The rotation of the mandrel 306 continues until the guide runner 346 reaches the terminus of the rotation slot 347 and/or the slips 314 are anchored. The slotted path may include an anchored slot 348 in which the guide runner 346 rests when the slips 314 are anchored. The anchored slot 348 prevents accidental rotation of the mandrel 306 and thereby the accidental release of the slips 314.

Figure 3I:
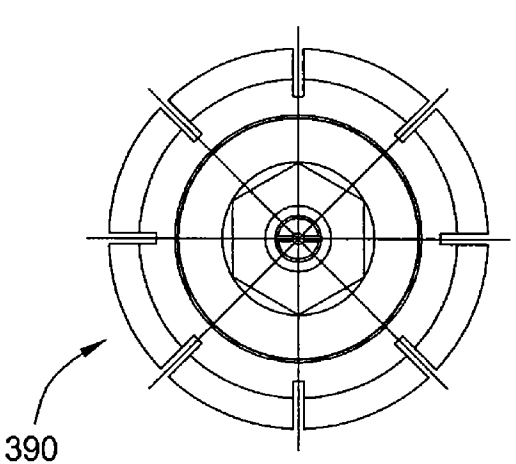
FIG. 3I is an end view of the expansion cone showing slots for fluid transfer.
Figure 3H:
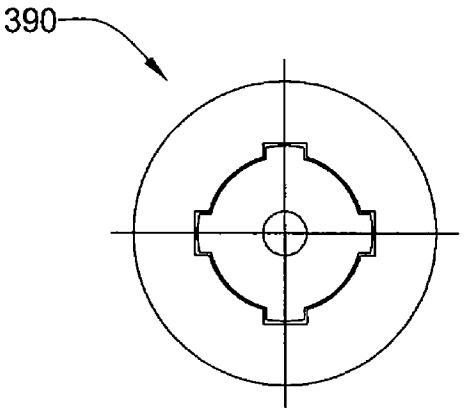
FIG. 3H is a cross sectional view of a torque transfer system according to one embodiment.
Figure 3G:
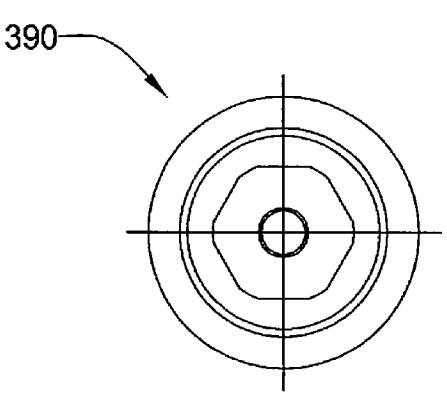
FIG. 3G is a cross sectional view of a torque transfer system according to one embodiment.
Figure 3K:
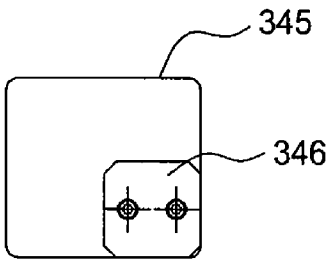
FIG. 3K is a view of a slotted path according to one embodiment.
Figure 3J:
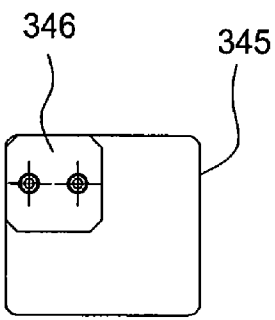
FIG. 3J is a view of a slotted path according to one embodiment.

In an additional or alternative embodiment, the slotted path 345 may be a movement limiter as shown in FIGS. 3J and 3K. The movement limiter may be any shape capable of limiting the movement of the guide runner 346. As shown, the movement limiter is a square slotted path adapted to constrain the movement of the guide runner 346. The square slotted path allows the guide runner 346 to move a small distance in both a rotational direction and an axial direction, thereby allowing the mandrel 306 to move relative to the outer cover 324 in an axial direction and rotational direction in order to set the slips as described herein. The guide runner 346 shown in FIG. 3K is in the unactuated position, rotation and axial movement of the guide runner relative to the square slotted path will set the slips while moving the guide runner 346 to the actuated position shown in FIG. 3J. The movement limiter may take any form depending on the relative movement required to set the slips, for example, the movement limiter may allow the guide runner 346 to only rotate, or only move axially relative to the slotted path 345.

The mandrel 306 may be coupled to, or integral with, a liner stop mandrel 350. The liner stop mandrel 350 is fixed to the mandrel 306 in a manner that prevents the liner stop mandrel 350 from moving relative to the mandrel 306. An adjustment nut 351 couples to the liner stop mandrel 350 in an adjustable manner. The adjustment nut 351 engages the upper end of the expandable tubular 110 while the expansion member 112 is expanding the expandable tubular 110. The adjustment nut 351 is shown in an expansion position wherein it is engaged with the expandable tubular 110. The adjustment nut 351 may be set in the expansion position prior to the BHA 104 being run into the casing 102, or be set when the BHA 104 is inside the casing 102 near the damaged portion. The lower end of the liner stop mandrel 350 includes a lower profile 352 configured to selectively connect the liner stop mandrel 350 to the inner string 304 as will be describe in more detail below.

The inner string 304 either directly or indirectly couples the connector 116 to the expansion member 112. The inner string 304 has a central bore 313, as shown in FIGS. 2 and 3, which may convey fluid through the BHA 104 and/or the expansion member 112 in order to lubricate the expansion member 112 during expansion. The inner string 304 may be any desired length depending on the size of the downhole operation. The inner string 304 moves with the BHA 104 and the mandrel 306 as one unit until the frangible connection 310 is released. Once the anchor 204 is set, the operator may pull up on the conveyance 114 which in turn pulls the inner string 304 upwards. The anchor 204 maintains the mandrel 306 stationary until the force required to disconnect the frangible connection 310 is met. With the force met, the frangible connection 310 releases the inner string 304 from the anchored mandrel 306. Continued pulling of the conveyance 114 pulls the inner string 304 and the expansion member 112 up relative to the mandrel 306 and the expandable tubular 110. The expansion member 112 engages the expandable tubular 110 in order to expand the tubular radially outward and into engagement with the inner diameter of the casing 102. The continued pulling of the inner string 304 may continue until the first latch 207 engages the setting assembly 108. With the first latch 207 engaged with the setting assembly 108, the inner string 304 may be manipulated in order to release the anchor 204. With the anchor 204 released, the BHA 104 without the expandable tubular 110 may be pulled from the casing 102 while continuing to expand the length of the expandable tubular 110 into engagement with the inner diameter of the casing 102.

As shown in FIG. 3, the inner string 304 is connected to the connector 116 at the upper end of the inner string 304. The lower end of the inner string 304 couples directly to the first latch 207. The first latch 207 includes a first latch mandrel 360 which couples directly to the inner string 304 at its upper end. The first latch mandrel may have a recess 361 and a shoulder 362 configured to provide support and flexibility for one or more collets 363. The collet 363 is biased by a collet bias 364 toward a locked position. In the locked position, the collet 363 engages the shoulder 362. The shoulder 362 prevents the collet 363 from moving radially inward. The collet bias 364 and part of the collet 363 may be housed between the first latch mandrel 360 and an outer latch mandrel 365. As shown, the collet bias is a coiled spring. Although, it should be appreciated that the collet bias may be any suitable biasing member.

In operation, the collet 363 remains in the locked position engaged against the shoulder until the collet 363 engages the lower end of the liner stop mandrel 350. When collet 363 engages a lower shoulder 366 of the liner stop mandrel 350, the shoulder 362 prevents the collet 363 from moving radially inward. Thus, the continued movement of the latch 207 upwards relative to the liner stop mandrel 350 forces the collet 363 to compress the collet bias 364, thereby moving the collet 363 beyond the shoulder 362. The lower shoulder 366 then pushes the collet 363 radially inward into the recess 361 thereby allowing the collet 363 to move past the lower shoulder 366. The collet 363 remains in the recess 361 until it reaches the lower profile 352 of the liner stop mandrel 350. When the collet 363 reaches the lower profile 352, the collet bias 364 pushes the collet 363 back into engagement with the shoulder 362. This prevents the inadvertent release of the collet 363 from the lower profile 352. Optionally, as illustrated in FIG. 3F, the lower profile 352 may include torque slots configured to receive the collets 363 and thereby transfer torque from the collets 363 to the liner stop mandrel 350. In the locked position, the collet 363 of the latch 207 couples the inner string 304 back to the mandrel 306 via the liner stop mandrel 350. Thus, with the latch 207 connecting the inner string 304 to the mandrel 306, tension, compression, and/or torque may be transferred from the conveyance to the inner string 304 and back to the mandrel 306. Thus, the inner string 304 may be used to disconnect the anchor 204 in the opposite manner as described above.

An optional second latch 209 is directly or indirectly coupled to the inner string 304. The second latch 209 allows an operator to disengage the expansion member 112 from the inner string 304 in the event that the expansion member becomes stuck in the wellbore. As shown, the first latch mandrel 360 couples to a sub connector 367 which couples to a second latch mandrel 370. The second latch 209 operates in a similar manner as the first latch 207 (with elements identified by reference numbers 371-375 corresponding respectively to 361-365); however, it is run into the wellbore in the locked position. The second latch 209 allows the operator to transfer torque from the inner string 304 to the expansion member 112 in the same manner as the first latch 207. The second latch 209 remains in the locked position until the expansion member 112 becomes stuck in the wellbore. If the use of torque and lubrication are unsuccessful at freeing the expansion member, the operator may release the second latch 209, thereby freeing the inner string 304 from the expansion member.

The expansion member 112, as shown, comprises an expansion mandrel 380 which is threaded to an expansion cone 382, according to one embodiment. The expansion member 112 may be the expander member disclosed in U.S. Patent Publication No. US2007/0187113 assigned to Weatherford/Lamb, Inc. which is herein incorporated by reference in its entirety. The outer surface of the expansion cone 382 may be threaded to the expandable tubular 110 in order to secure the expandable tubular to the BHA 104 during run in. The expansion mandrel 380 may include one or more ports 384 located around the circumference of the expansion mandrel 380. The one or more ports 384 provide a flow path for lubricating fluid to flow through. The lubricating fluid flows between the expandable tubular 110 and the expansion cone 382. The expansion cone 382 comprises a flared portion 386 capable of mechanically deforming the expandable tubular 110 into engagement with the casing 102. The expansion cone 382 is pulled through the expandable tubular 110 using the hoisting assembly 134 pulling the conveyance 114 and thereby pulling the inner string 304.

The BHA 104 may include one or more torque transfer systems 390 between the work string and/or mandrels. FIGS. 3G, 3H, and 3I illustrate some examples of torque transfer systems 390. It should be appreciated that other suitable torque transfer systems 390 may be used.

The expandable tubular 110 may be any tubular suitable for radial expansion without causing failure of the tubular. The expandable tubular 110 may be any desired length. The inner string may be sized based on the length of the expandable tubular 110. Because the BHA 104 is not limited by the stroke of a hydraulic jack, the expandable tubular may be several thousand feet long if desired. The expandable tubular 110 may include one or more anchors 400 and one or more seals 402, as shown in FIG. 4, coupled to the outer surface of the tubular in order to secure and seal the damaged portion of the casing 102.

Figure 4:
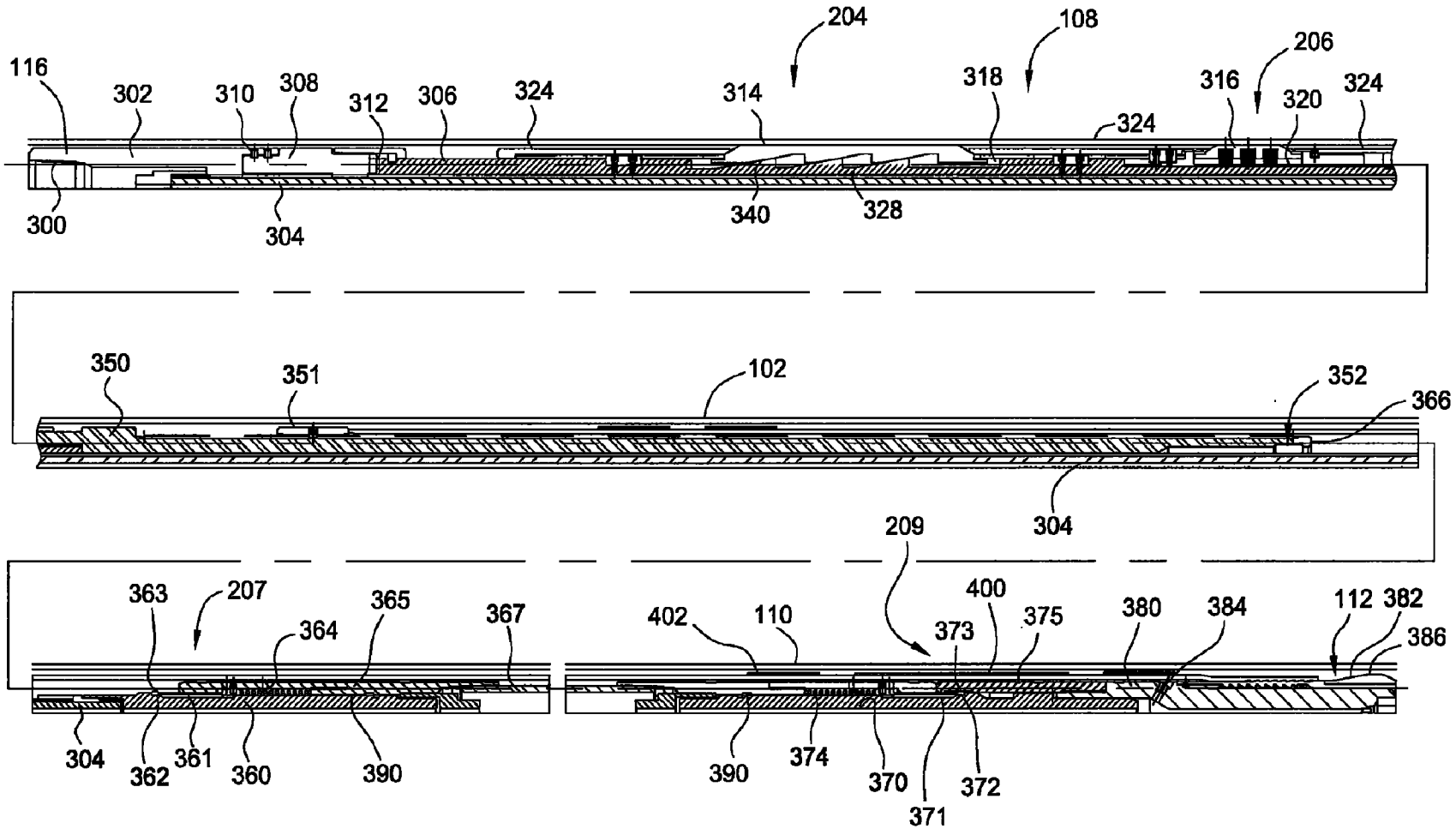
FIG. 4 is a partial cross section of a BHA with the anchor actuated according to one embodiment.
Figure 5:
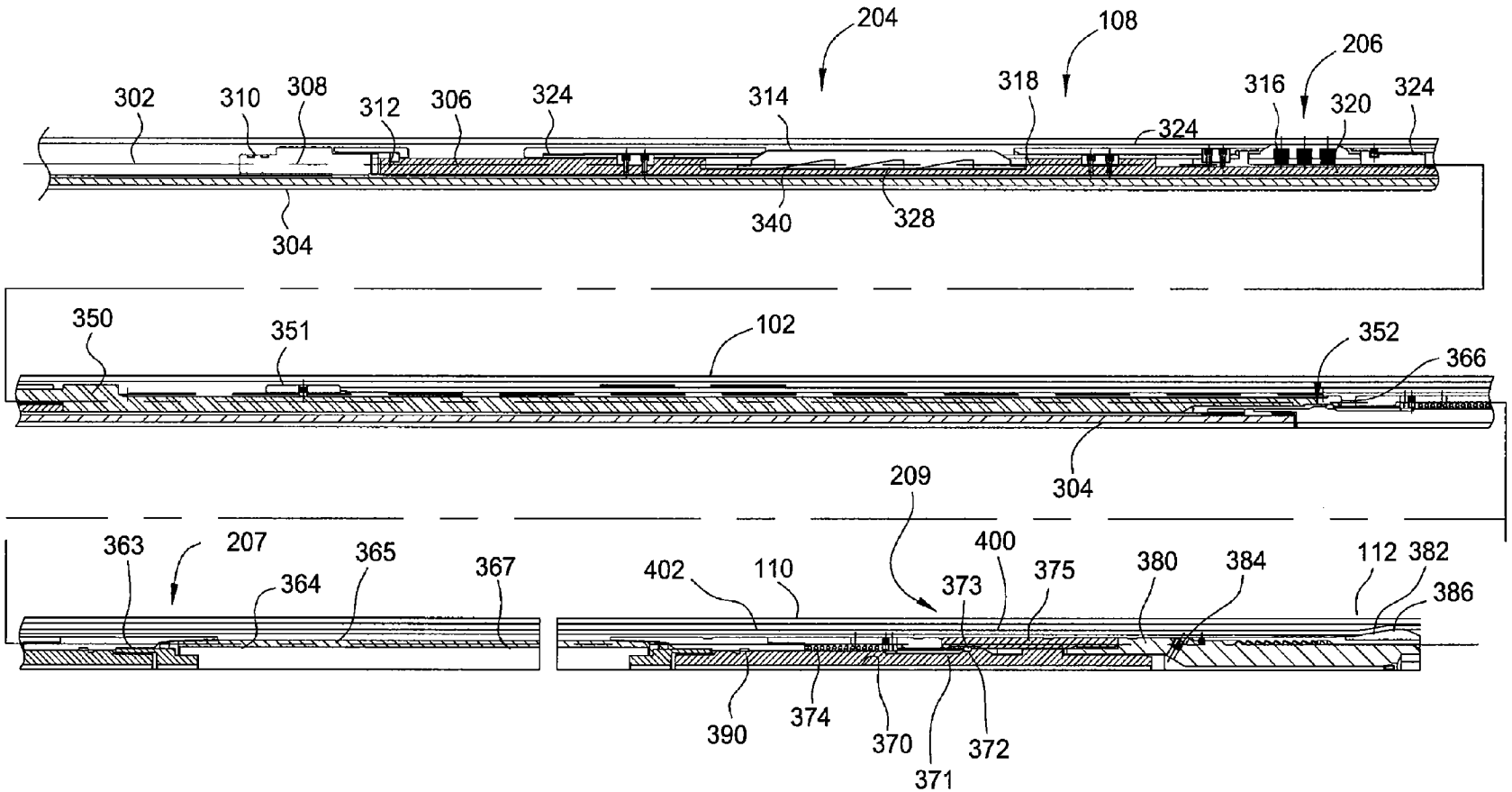
FIG. 5 is a partial cross section of the BHA upon beginning an expansion operation according to one embodiment.

FIG. 4 shows the anchor 204 engaged with the casing 102 prior to release of the frangible connection and expansion of the expandable tubular 110. FIG. 5 shows the frangible connection released and the expansion cone having expanded a portion of the expandable tubular 110 into engagement with the casing 102. With the portion of the expandable tubular 110 engaged with the casing 102 the anchor 204 has been released from the casing 102. The continued moving of the expansion member 112 upwards expands the remainder of the expandable tubular 110.

The slips 314 and the drag blocks 316 may be easily replaced and sized. Thus, the BHA 104 may be used on a larger or smaller casing 102 by simply replacing the size of the slips 314 and the drag blocks 316.

In operation, the inner string 304 and the expandable tubular 110 are sized based on the length of the damaged portion 106 of the casing 102. The BHA 104 is assembled and brought to the drilling rig 130. The BHA 104 is connected to a conveyance 114 and lowered into the wellbore by the hoisting assembly 134. The BHA 104 continues into the wellbore until it reaches the damaged portion 106. Upon reaching the damaged portion 106 of the wellbore the anchor 204 of the setting assembly 108 is actuated. A friction member 206 holds a portion of the BHA 104 stationary relative to the casing 102 in order to provide a resistive force for the setting of the anchor. The anchor 204 engages the inner wall of the casing 102, thereby preventing the anchor 204 and the expandable tubular 110 from moving relative to the casing. A frangible connection is then released thereby releasing the inner string 304 from the anchor 204 and the expandable tubular 110. The hoisting assembly 134 then pulls the conveyance 114 and thereby the inner string 304. The inner string 304 pulls an expansion member 112 through the expandable tubular 110. The expansion member 112 mechanically expands the expandable tubular 110 into engagement with the inner wall of the casing 102. During the expansion, a lubricating fluid may be pumped down the conveyance 114 through the BHA 104 and between the expansion member 112 and the expandable tubular 110. The expansion member 112 continues upward until a latch 207 recouples the inner string 304 to the anchor 204. The conveyance 114 may then be manipulated in order to release the anchor 204 from the casing 102. With the anchor 204 free, the entire BHA 104 minus the expandable tubular 110 may be pulled out of the expandable tubular 110. As the BHA 104 moves through the remainder of the expandable tubular 110, the expansion member 112 engages the remainder of the expandable tubular 110 with the casing 102.

In the event the expansion member 112 becomes stuck in the expandable tubular 110 a second latch is released thereby freeing the expansion member 112 from the inner string 304. The inner string 304 minus the expansion member 112 and the expandable tubular 110 may be used to unset the anchor, as described above, and run out of the wellbore. A fishing operation may then be performed to free the expansion member 112 from the expandable tubular 110.

While the foregoing is directed to embodiments of the present invention, other and further embodiments of the invention may be devised without departing from the basic scope thereof, and the scope thereof is determined by the claims that follow.

What is claimed is:

1. A bottom hole assembly (BHA) for expanding a tubular in a wellbore, comprising:
- a mandrel;
- a slip radially movable between a set and unset position, wherein the slip is operable to engage the wellbore in the set position;
- a friction member operable to engage the wellbore;
- a cover connecting the slip to the friction member;
- a slip block connected to the mandrel and having a longitudinal ramp and a recess;
- a runner connected to one of the mandrel and the cover and a path formed in the other of the mandrel and the cover, the runner and the path operable to allow limited axial movement and rotation of the mandrel relative to the cover;
- an inner string releasably connected to the mandrel and connectable to a tubular workstring, wherein the releasable connection between the inner string and the mandrel is axial and torsional;
- an expansion member axially coupled to the inner string;
- an expandable tubular operably connected to the expansion member and the mandrel;
- a latch operable to re-connect the inner string to the mandrel,
- wherein:
  - a portion of the slip is disposed in the recess in the unset position, and
  - the slip is movable to the set position by:
    - rotating the inner string, thereby aligning the slip block and the slip, and
    - pulling the inner string, thereby moving the longitudinal ramp relative to the slip.

2. The BHA of claim 1, further comprising a port in fluid communication with a bore of the inner string and operable to supply lubricant to a leading surface of the expansion member.

3. The BHA of claim 1, wherein the inner string is torsionally coupled to the expansion member.

4. The BHA of claim 1, further comprising a second latch operable to release the expansion member from the inner string.

5. The BHA of claim 1, wherein the expansion member is operably coupled to the expandable tubular by a threaded connection.

6. The BHA of claim 1, further comprising a nut connected to the mandrel and operable to engage the expandable tubular during expansion.

7. The BHA of claim 1, wherein the inner string is releasably connected to the mandrel by a frangible connection.

8. The BHA of claim 1, wherein:
- the latch is operable to re-connect the inner string and the mandrel axially and torsionally, and
- the slip is movable to the unset position by counter-rotating the inner string, thereby aligning the slip and the recess.

9. The BHA of claim 1, wherein the friction member comprises drag blocks.

10. A method of expanding a tubular in a wellbore, comprising:

running a bottom hole assembly (BHA) into the wellbore using a connected workstring, wherein the BHA comprises a mandrel, a slip, a friction member, a cover, an inner string, an expansion member, an expandable tubular, and a latch;

rotating the workstring, thereby rotating the mandrel relative to the slip and aligning a longitudinal ramp of a slip block and the slip, wherein the slip is held stationary by engagement of the friction member with the wellbore and the cover;

pulling the workstring, thereby:

moving the longitudinal ramp relative to the slip, moving the slip radially from an unset position to a set position in engagement with the wellbore, and releasing the mandrel from the inner string and advancing the expansion member through the expandable tubular held stationary by the mandrel, wherein the workstring is pulled until the latch re-connects the inner string to the mandrel;

counter-rotating the workstring, thereby:

counter-rotating the mandrel relative to the slip, aligning a recess of the slip block with the slip, and unsetting the slip from engagement with the wellbore; and retrieving the BHA minus the expanded tubular from the wellbore using the connected workstring.

11. The method of claim 10, wherein:

the BHA further comprises a port, and the method further comprises injecting lubricant through the workstring, the inner string, and the port, thereby supplying lubricant to a leading surface of the advancing expansion member.

12. The method of claim 10, wherein a casing is cemented to the wellbore and the tubular is expanded into engagement with a damaged portion of the casing.

* * * * *